US007171961B1

(12) United States Patent
Terry

(10) Patent No.: US 7,171,961 B1
(45) Date of Patent: Feb. 6, 2007

(54) ARCHERY BOW WITH MISMATCHED LIMBS

(76) Inventor: Edgell Terry, 1115 Shady La., Rome City, IN (US) 46784

( * ) Notice: Subject to any disclaimer, the term of this patent is extended or adjusted under 35 U.S.C. 154(b) by 0 days.

(21) Appl. No.: 11/001,717

(22) Filed: Dec. 2, 2004

Related U.S. Application Data

(60) Provisional application No. 60/526,552, filed on Dec. 3, 2003.

(51) Int. Cl.
*F41B 5/10* (2006.01)

(52) U.S. Cl. ..... 124/25.6

(58) Field of Classification Search ..... 124/23.1, 124/25.6
See application file for complete search history.

(56) References Cited

U.S. PATENT DOCUMENTS

| | | | | |
|---|---|---|---|---|
| 4,365,611 | A * | 12/1982 | Nishioka | 124/25.6 |
| 5,368,006 | A * | 11/1994 | McPherson | 124/25.6 |
| 6,237,582 | B1 * | 5/2001 | McPherson | 124/25.6 |
| 6,443,139 | B1 * | 9/2002 | McPherson | 124/25.6 |
| 6,634,347 | B2 * | 10/2003 | Holler | 124/23.1 |

* cited by examiner

*Primary Examiner*—John A. Ricci
(74) *Attorney, Agent, or Firm*—Taylor & Aust, P.C.

(57) ABSTRACT

An archery bow includes a riser having an upper end and a lower end. An upper flexible limb extends from the upper end of the riser, and a lower flexible limb extends from the lower end of the riser. The upper limb and the lower limb each have a distal end. The upper limb is longer than the lower limb, and the upper limb has a draw rating which is less than a draw rating of the lower limb. A cam is pivotally coupled to the upper limb distal end, and a pulley is pivotally coupled to the lower limb distal end.

17 Claims, 2 Drawing Sheets

ARCHERY BOW WITH MISMATCHED LIMBS

CROSS REFERENCE TO RELATED APPLICATIONS

This is a non-provisional application based upon U.S. provisional patent application Ser. No. 60/526,552, entitled "SOLO CAM ARCHERY BOW", filed Dec. 3, 2003.

BACKGROUND OF THE INVENTION

1. Field of the Invention

The present invention relates to archery bows, and, more particularly, to archery bows with at least one cam arrangement.

2. Description of the Related Art

Various types of archery bows have been developed, including traditional bows (i.e., long bows and recurved bows) and compound bows. All archery bows include a pair of opposed limbs extending from a riser or handle of the bow. As an archer draws the bow by pulling on a string, the limbs flex and store energy. This energy is transferred to the arrow as the archer releases the string.

A compound bow is a popular design for archery bows and includes one or more cams (for example, eccentric wheels or pulleys). Compound bows use a cable or string system which extends over at least one cam rotatably mounted at a distal end of a bow limb to provide a mechanical advantage during the drawback of the string. Such cams enable a peak draw force (i.e., a peak pull force on a drawstring of a bow to maintain a draw) to be reached in the middle of a draw such that the draw force drops at full draw.

With this arrangement, when the drawstring is in the full draw position, maximum potential energy is stored in the bow while the force required to maintain the drawstring in the full draw position is less than the maximum draw force of the bow. In short, as the drawstring is being drawn, the draw force applied to the bow increases to a maximum force and reduces to a lower draw force at the full draw position. Accordingly, maximum energy is stored in the limbs without requiring maximum force to be applied to the drawstring to hold the bow at the full draw position. This permits the archer to maintain aim on his target prior to release for a longer period of time for a better shot.

Examples of different types of compound bow arrangements include the so called "hatchet" bow having dual cams, the so called "solo cam" bow having a cam at one end and an idler pulley at the other end, and the so called "cam and a half" bow such as manufactured by Hoyt U.S.A™.

Regardless of the particular type of compound bow arrangement used, a common understanding is that the bow must be balanced or "tuned" to achieve satisfactory performance. This generally means that the length of the limbs extending from the riser must be the same, the draw rating of each limb must be the same, and certain other dimensions must be achieved. It is generally believed that if a bow is not tuned in this manner, satisfactory performance will not be achieved.

SUMMARY OF THE INVENTION

The present invention provides a solo cam archery bow arrangement in which the limbs are intentionally mismatched and yet good performance is achieved.

The invention comprises, in one form thereof, an archery bow including a riser having an upper end and a lower end.

An upper flexible limb extends from the upper end of the riser, and a lower flexible limb extends from the lower end of the riser. The upper limb and the lower limb each have a distal end. The upper limb is longer than the lower limb, and the upper limb has a draw rating which is less than a draw rating of the lower limb. A cam is pivotally coupled to the upper limb distal end, and a pulley is pivotally coupled to the lower limb distal end.

An advantage of the present invention is that very good performance, including trajectory and accuracy, are achieved.

Another advantage is that the forward jumping reaction of the bow upon firing is minimized.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
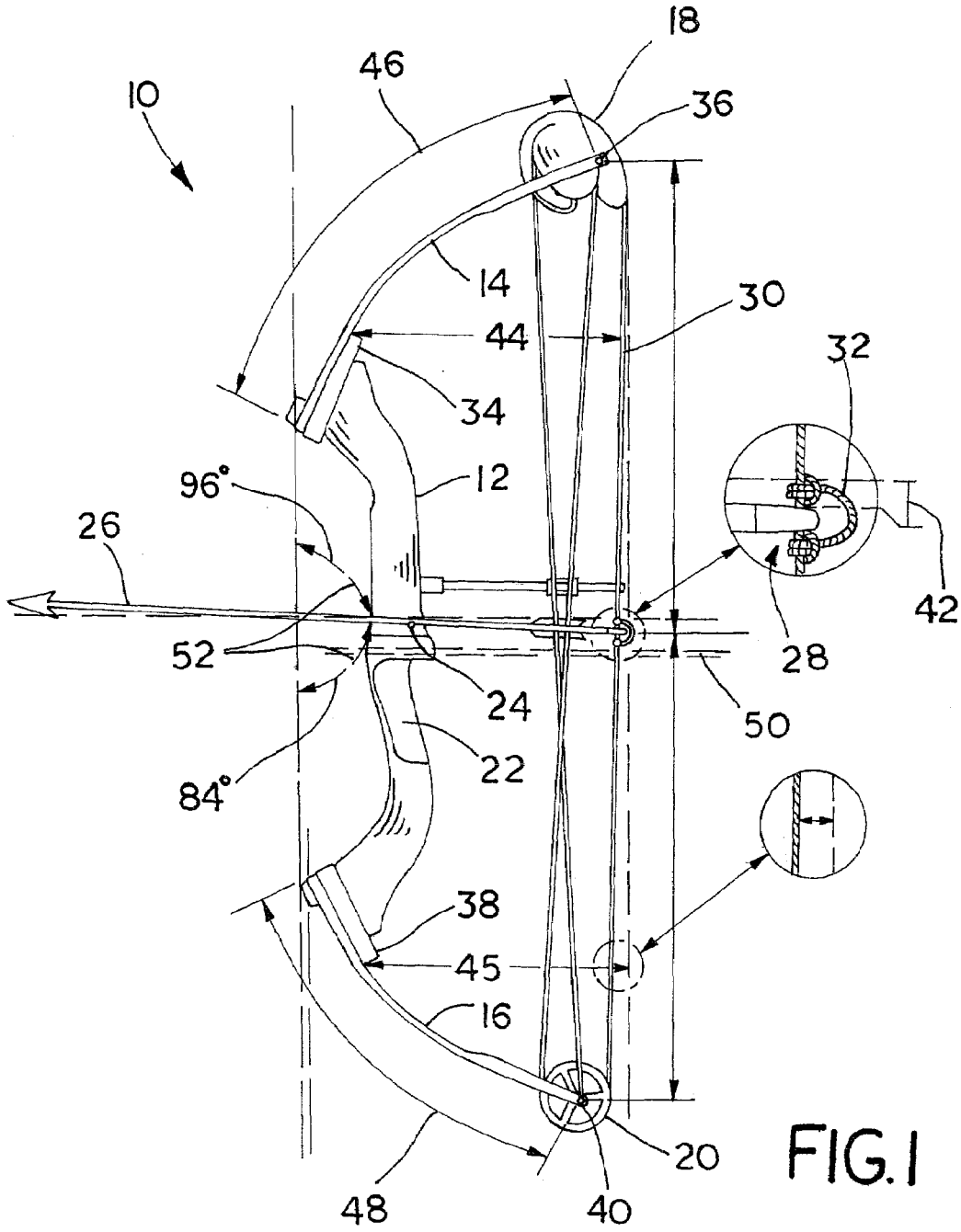
FIG. 1 is a side view of an embodiment of an archery bow of the present invention when in a relaxed state.
Figure 2:
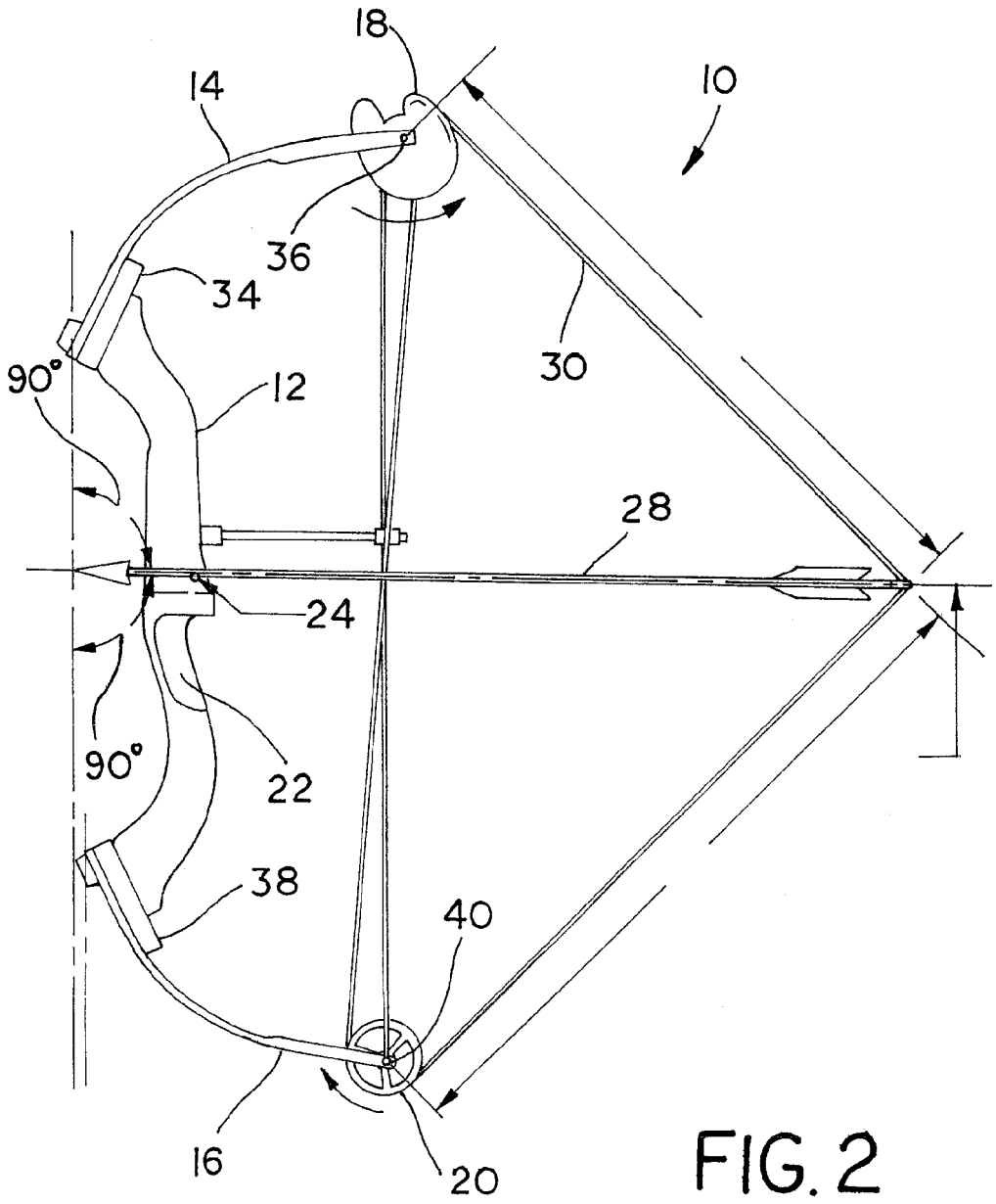
FIG. 2 is a side view of the archery bow of FIG. 1 when in a drawn state.

Referring now to FIGS. 1 and 2, there is shown an embodiment of an archery bow 10, including a riser 12, a pair of flexible limbs 14, 16, and a pair of rotating members 18, 20.

Riser 14 includes a handgrip 22 and an arrow rest 24. Multiple different types of arrow rests are available, and thus are not shown in specific detail for simplicity sake. Arrow 26 carried by arrow rest 24 defines a sight plane corresponding to the trajectory path of the arrow. The base end of arrow 26 engages a nock location 28 on bow string 30. A nock set 32 is engaged by a hand release (not shown) during use. It will thus be appreciated that bow string 30 also lies within the sight plane of arrow 26. The sight plane may be adjusted somewhat by laterally adjusting arrow rest 24.

Upper limb 14 is attached to upper end 34 of riser 14, and includes a distal end 36 to which rotating member 20 in the form of a cam is pivotally mounted. Similarly, lower limb 16 is attached to lower end 38 of riser 14, and includes a distal end 40 which pivotally carries rotating member 20 in the form of a pulley. In the embodiment shown, cam 18 includes a primary cam and a secondary cam. Bow string 30 partially wraps and extends between cam 18 and idler pulley 20 for engagement with arrow 26 at nock location 28.

Nock location 28 is set about ⅜ inch below the centerline of arrow rest 24 which brings the nocking point on the string within ⅛ inch of being center from axle to axle. Referring to FIG. 2, dimension 42 shows the difference from a standard tuning location. Dimension line 50 shows the true centerline of bow 10 from axle to axle (i.e., midway bewteen pivot axes of cam 18 and pulley 20, and parallel to 90 degree axis of bow 10). As shown by angular dimensions 52 in FIG.

1, arrow 26 will be out of parallel to the bow plane corresponding to dimension line 50 by 6 degrees with the tip of the arrow at the higher point when tuned in this particular manner, when bow 10 is in an at rest position.

The tiller dimension is the distance between the string and the limb at the end of the riser. When setting the tiller, conventional bows typically call for the lower tiller dimension 42 to be ⅛" to ¼" less than the upper tiller dimension for tuning when the bow is at an at rest position. In contrast, the present invention provides tuning at a range of between approximately ½ to 1½ inches, preferably between approximately ¾ to 1¼ inches, and more preferably approximately 1 inch.

Upper limb 14 has a length 46 of between approximately ½ to 2 inches, and preferably approximately 1½ inches, greater than the length 48 of lower limb 16. Upper limb 14 also has a draw rating which is between approximately 5 to 20 pounds less than a draw rating of lower limb 16, preferably approximately 10 pounds less than a draw rating of lower limb 16.

In the embodiment shown, lower limb 16 is ½ inches shorter than upper limb 14, and is rated 10 greater than upper limb 14. In this case, lower limb 16 is rated as a 70 pound limb and upper limb 14 is rated as a 60 pounds limb. This combination gives the bow a maximum draw weight of 65 pounds at a 29 inch draw, with axle-to-axle dimensions of 37 inches. In order to create lower or higher poundage, the draw rating of each limb may be reduced or increased by, e.g., 10 pounds, while still maintaining the same 1½ inch difference in limb length.

The plane of arrow 26 becomes parallel to the 90 degree axis of the bow when at full draw. This is created by upper limb 14 having a greater reflex than lower limb 16. When the bow is shot, the arrow at nock location 28 is swept down through the plane off parallel creating a greater lift of arrow 26 from the point that it leaves bow 10. In turn, arrow 26 travels in a smooth arc from the firing point to the target point, maintaining a consistent flight path, shot after shot.

By mounting cam 18 on upper limb 14, opposite conventional solo cam bows, a smooth and shock-free bow is provided. When shot, upper limb 14 and lower limb 16 release the stored energy and snap cam 18 in a counter clockwise rotation as viewed in the figures, making bow 10 want to come to the rear. The forward movement of string 30 casting arrow 26, the forward actions of limbs 14 and 16, and the reverse action of cam 18 come together at the same time. This minimizes any adverse reactions, commonly known as a shock or forward jumping reaction.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An archery bow, comprising:

a riser having an upper end and a lower end;

an upper flexible limb extending from said upper end of said riser, and a lower flexible limb extending from said lower end of said riser, each of said upper limb and said lower limb having a distal end, said upper limb being longer than said lower limb, and said upper limb having a draw rating which is less than a draw rating of said lower limb;

a cam pivotally coupled to said upper limb distal end;

a pulley pivotally coupled to said lower limb distal end; and a string partially wrapping and extending between said cam and said pulley, said riser upper end and said string defining an upper tiller dimension therebetween, said riser lower end and said string defining a lower tiller dimension therebetween, said lower tiller dimension being between approximately ½ to 1½ inches shorter than said upper tiller dimension.

2. The archery bow of claim 1, wherein said upper limb has a length which is between approximately between ½ and 2 inches longer than a length of said lower limb.

3. The archery bow of claim 2, wherein said upper limb has a length which is approximately 1½ inches longer than a length of said lower limb.

4. The archery bow of claim 1, wherein said upper limb has a draw rating which is between approximately 5 to 20 pounds less than a draw rating of said lower limb.

5. The archery bow of claim 4, wherein said upper limb has a draw rating which is 10 pounds less than a draw rating of said lower limb.

6. The archery bow of claim 1, wherein said lower tiller dimension is between approximately ⅞ to 1¼ inches shorter than said upper tiller dimension.

7. The archery bow of claim 6, wherein said lower tiller dimension is approximately 1 inches shorter than said upper tiller dimension.

8. An archery bow, comprising:

a riser having opposite ends;

a pair of flexible limbs respectively extending oppositely from said opposite ends of said riser, each said limb having a distal end, one of said limbs being longer than an other of said limbs;

a pair of rotating members, each said rotating member pivotally coupled to a respective said distal end; and a string partially wrapping and extending between said rotating members, each said riser end and said string defining a tiller dimension therebetween, one said tiller dimension being between approximately ½ to 1½ inches shorter than an other said tiller dimension.

9. The archery bow of claim 8, wherein said one limb has a length which is between approximately between ½ and 2 inches longer than a length of said other limb.

10. The archery bow of claim 9, wherein said one limb has a length which is approximately 1½ inches longer than a length of said other limb.

11. The archery bow of claim 8, wherein said one limb has a draw rating which is less than a draw rating of said other limb.

12. The archery bow of claim 11, wherein said one limb has a draw rating which is between approximately 5 to 20 pounds less than a draw rating of said other limb.

13. The archery bow of claim 12, wherein said one limb has a draw rating which is 10 pounds less than a draw rating of said other limb.

14. The archery bow of claim 11, wherein said one limb is an upper limb and said other limb is a lower limb.

15. The archery bow of claim 11, wherein said rotating member on said upper limb comprises a cam, and said rotating member on said lower limb comprises a pulley.

16. The archery bow of claim 8, wherein said one tiller dimension is between approximately ⅞ to 1¼ inches shorter than an other said tiller dimension.

17. The archery bow of claim 16, wherein said one tiller dimension is approximately 1 inches shorter than an other said tiller dimension.

* * * * *